United States Patent [19]

Ishida et al.

[11] Patent Number: 4,835,994

[45] Date of Patent: Jun. 6, 1989

[54] WASHING MACHINE

[75] Inventors: Katsuyuki Ishida; Fumio Torita, both of Nagoya; Yoshio Kohsaka, Aichi, all of Japan

[73] Assignee: Kabushiki Kaisha Toshiba, Kawasaki, Japan

[21] Appl. No.: 606,265

[22] Filed: May 2, 1984

[30] Foreign Application Priority Data

Jun. 9, 1983 [JP] Japan ..... 58-104505
Jun. 27, 1983 [JP] Japan ..... 58-115453

[51] Int. Cl.[4] ..... D06F 21/08
[52] U.S. Cl. ..... 68/174; 68/23.3
[58] Field of Search ..... 68/23 R, 23.3, 38, 53, 68/89, 136, 148, 154, 171, 172, 173, 174; 210/364, 365

[56] References Cited

U.S. PATENT DOCUMENTS 1,211,129 1/1917 Franklin ..... 68/89
2,156,541 5/1939 Misenhimer et al. ..... 68/174 X
2,575,691 11/1951 Smith ..... 68/174 X
2,652,710 9/1953 DeRemer ..... 210/365 X
2,656,042 10/1953 Geldhof et al. ..... 210/364
2,986,916 6/1961 Bochan ..... 68/171 X
3,278,037 10/1966 Stelli et al. ..... 210/365 X
3,603,118 9/1971 Brucken et al. ..... 68/23 R
4,464,914 8/1984 Torita ..... 68/23.5

FOREIGN PATENT DOCUMENTS 36-13469 8/1961 Japan .
49-33863 9/1974 Japan .
51-56580 5/1976 Japan .
55-25878 2/1980 Japan .

*Primary Examiner*—Philip R. Coe
*Attorney, Agent, or Firm*—Foley & Lardner, Schwartz, Jeffery, Schwaab, Mack, Blumenthal & Evans

[57] ABSTRACT

A washing machine having a washing tub including a fixed drum mounted on the upper side thereof, and a movable drum disposed under the fixed drum so as to rotate horizontally. The fixed drum has projection parts for providing clothes with a contact friction force on the inner wall thereof.

13 Claims, 6 Drawing Sheets

WASHING MACHINE

BACKGROUND OF THE INVENTION

The invention relates to a washing machine and more particularly to an improved washing tub.

Conventional washing machines generally accomplish washing action by establishing a vortex flow within a washing tub to repeatedly agitate the clothes being washed. In such a machine, it is required to utilize a rather large tub capacity when compared to the amount of clothes being washed. In the case where a small load of clothes is desired to be washed, the vortex flow is so vigorous that the clothes are excessively washed, and may be damaged. On the other hand, if a large amount of clothes are washed, the vortex flow becomes too slow and the clothes are not washed enough.

Moreover, since the clothes only accidently contact the agitator of the washing machine, one may not expect that all of the clothes are washed enough by the twisting effect of the agitator within the washing tub. Conversely, the clothes which do contact the agitator frequently, are washed excessively, so that some articles being washed are damaged within the washing tub.

Recently, a new type of washing machine is available. This type of washing machine, does not have an agitator, but does have a washing tub which is horizontally rotatable with the washing liquid and clothes placed therein. The tub is intermittently rotated in forward and reverse directions to wash the clothes through a vortex flow and the difference in rotational speed between the washing liquid and clothes.

In such an apparatus, the clothes are not damaged. Examples of such washing machines are shown in Japanese patent publications Nos. 51-56580, 49-33863, and U.S. Pat. No. 2,986,916. Other examples of related art include Japanese patent disclosures Nos. 36-13469 and 55-25878. However, in this type of washing machine the washing efficiency is poor, because the difference in the rotational speed of the liquid and clothes is small. Accordingly, such conventional washing machines fail to wash clothes in a homogeneous manner, particularly when the washing load varies from small to large.

SUMMARY OF THE INVENTION

It is a primary object of the present invention to provide an improved washing machine.

It is another object of the invention to provide a washing machine, wherein clothes are washed in a homogeneous and thorough manner without damage to the clothes.

It is a further object of the invention to provide an improved washing tub.

To accomplish the foregoing and other objects in accordance with a preferred embodiment of the invention, a washing machine has a washing tub which includes a fixed drum mounted on the upper side of the tub and a movable drum disposed under the fixed drum so as to rotate horizontally and alternately in forward and reverse directions. The fixed drum has projections at the inner side thereof.

BRIEF DESCRIPTION OF THE DRAWINGS

Features of the present invention will be apparent from the following drawings wherein.

DETAILED DESCRIPTION OF THE PREFERRED EMBODIMENT

Figure 1:
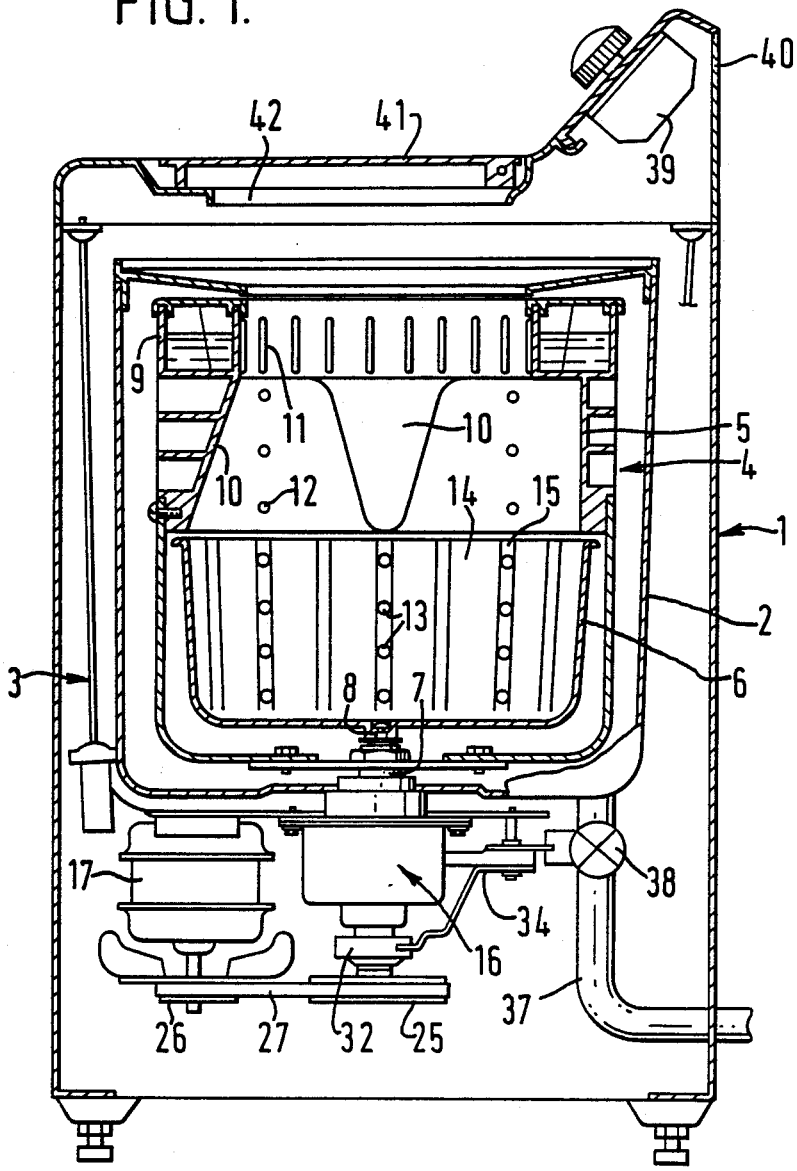
FIG. 1 is a vertical sectional view showing a first embodiment of a washing machine according to the present invention.
Figure 2:
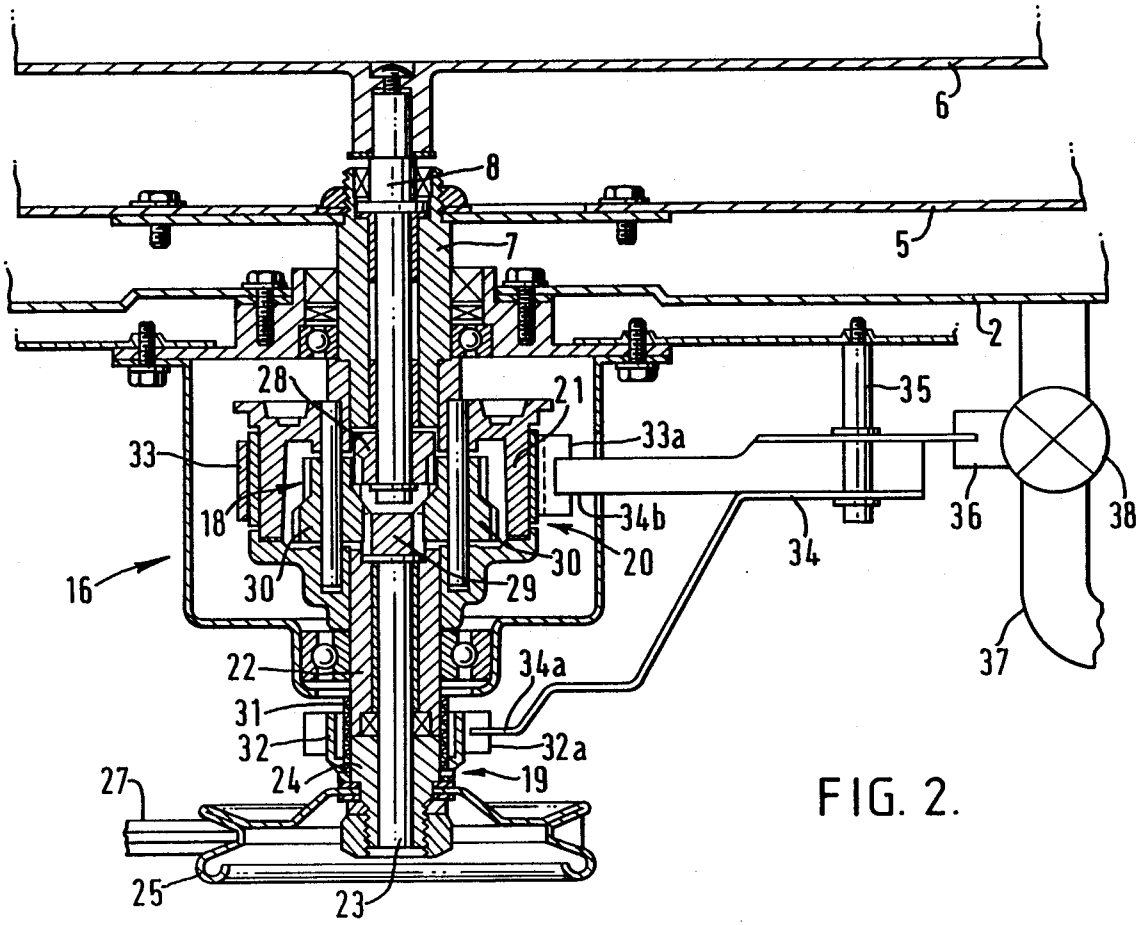
FIG.2 is an enlarged vertical sectional view showing a transmission mechanism of the invention.

Referring now more specifically to the drawings, a first embodiment of a washing machine according to the invention will be described in FIGS. 1 through 4. In these figures, housing 1 includes a water-receiving tub 2 suspended by elastic suspension member 3, so as to absorb erratic movement of the tub 2. Water-receiving tub 2 is itself fixedly mounted with respect to washing tub 4 which, in the embodiment of the washing machine shown, serves the dual purpose of a washing and drying tub. One should, of course, appreciate that the present invention can also be suitably utilized when the tub 4 is solely a washing tub.

The washing tub 4 is disposed in the tub 2, and is fixedly connected to rotary drying shaft 7 of a transmission 16 which transmits rotary movement in a predetermined manner. The washing tub 4 includes a fixed drum 5 and a movable drum 6. The fixed drum 5 is fixedly mounted on the upper side of the washing tub 4. The movable drum 6 is disposed under the drum 5 as a basket and is fixedly connected to rotary washing shaft 8. Fixed drum 5 is rotated with movable drum 6 through the shafts 7, 8 during drying cycles, and is stationary during washing cycles while movable drum 6 is rotated through the shaft 8 disposed on the shaft 7. The diameter of movable drum 6 is almost the same as the drum 5. The inner wall of drum 6 is rugged, and it has a depth of about half that of the washing tub 4.

The fixed drum 5 has a balancer 9 at the top thereof, and the balancer 9 holds a liquid therein so as to balance the rotation of tub 4 during drying cycles. Also, the drum 5 has several projection parts 10 on the inner wall thereof. Each projection part 10 is smoothly undulating and is in the shape of an upside-down triangle between balancer 9 and movable drum 6, and decreases in thickness in going from its upper to lower portion thereof, as shown in the figures. Many projecting ribs 11 are formed on the inner wall of the balancer 9. The fixed drum 5 and movable drum 6 respectively have spaced openings 12 and 13. Movable drum 6 has alternating convex parts 14 and concave parts 15 on the inner wall thereof. The spaced openings 13 are formed at the concave parts 15 of movable drum 6 to drain off water.

The transmission 16 includes a reduction mechanisms 18, a clutch mechanisms 19 and a brake mechanisms 20 for selectively transmitting the rotary motion provided by driving motor 17 to the rotary shafts 7 and 8.

Shaft 7 is connnected to outer shaft 22 through gear drum 21, wherein there is provided an inner shaft 23 connecting with sleeve member 24. The sleeve member 24 is fixed to driven pulley 25 so as to transmit the rotary motion of motor 17 to the inner shaft 23 through belt 27. The reduction mechanisms 18 includes gears 28, 29, and a two-way gear 30. The gears 28, 29 are mounted on the shafts 8 and 23 respectively. The gear 30 is supported by the drum 21 so as to rotate both gears 28 and 29 within the drum 21. The clutch mechanisms 19 includes a clutch spring 31 and a clutch member 32 having many latches 32*a*. The spring 31 is wound around both shaft 22 and sleeve member 24. The clutch 32 contacts the spring 31 at the lower end thereof.

When clutch 32 is prevented from rotating by latch 32*a*, it may not operate to wind up spring 31. Accordingly, movable drum 6 is merely rotated at a low speed through reduction mechanisms 18, since the rotary motion of motor 17 is transmitted only to the inner shaft 23. When clutch 32 is permitted to rotate, it may wind up spring 31. In this case, since the rotary motion of motor 17 is transmitted to both outer shaft 22 and inner shaft 23, fixed drum 5 is rotated in the forward direction at high speed together with the movable drum 6.

The brake mechanisms 20 has a brake band 33 that is in the shape of an ended loop and has a stopper 33*a* at the outside thereof. The brake band 33 is installed around gear drum 21 so as to be tightened by rotary motion of drum 21.

If brake band 33 is prevented for rotating by stopper 33*a*, drum 21 and fixed drum 5 are prevented from rotating. When brake band 33 is allowed to rotate, fixed drum 5 may also rotate. The brake band 33 does not rotate when stopper 33*a* touches a tip portion 34*b* of lever means 34 which is installed on a pivot shaft 35. Also, the drum 5 is prevented from rotating when latch 32*a* contacts an end member 34*a* of the lever 34. The movement of lever 34 is controlled by an electromagnet means 36. Moreover, the means 36 controls a drain valve 38 by which washing-liquid is drained from the water-receiving tub 2 through a drain hose 37.

A control panel 40 includes a timer means 39 so as to automatically control the washing process from washing cycles to drying cycles. A cover means 41 opens and shuts an opening 42 utilized for putting clothes into the machine and removing them therefrom.

In the construction as described above, electromagnet means 36 is not operated on the washing cycles, and drain valve 38 is closed. The lever means 34 is allowed to bind both clutch member 32 and brake band 33 so as to prevent their rotation. On the drying cycles, the means 36 is operated so that lever means 34 is moved. As a result, means 34 does not bind both clutch member 32 and brake band 33. Therefore, fixed drum 5 continues to be stopped by means of brake mechanisms 20 during the washing cycles, even if movable drum 6 is alternately rotated in forward and reverse direction.

The washing machine operates in the following manner. In the washing operation, washing liquid is first poured into the water-receiving tub 2, i.e., washing tub 4, and clothes are also placed therein. The movable drum 6 is rotated by motor 12 through transmission 11, while fixed drum 5 is restricted from rotating through brake mechanisms 20. The movable drum 6 is rotated 120–180 revolutions per minute, and is rotated in alternate directions every second or third revolution. In such a manner, clothes contact with both movable drum 6 and fixed drum 5 at numerous portions of washing tub 4. Clothes positioned toward the interior of movable drum 6 are swung by frictional force into contact with other clothes similarly positioned and with the wall of movable drum 6, while clothes positioned on the periphery of drum 6 are exposed to a force opposite to the rotationally directed force due to frictional contact with the wall of fixed drum 5. Accordingly, clothes are repeatedly affected by twisting and compressing actions because movable drum 6 is alternately rotated in forward and reverse directions. Further, clothes within drum 6 which experience centrifugal force are flung against the wall of fixed drum 5 and drop toward the inside of drum 6. Such operation turns the clothes upside down in a random fashion. The clothes further come in contact with projection parts 10 during rotary motion of movable drum 6. As a result, the clothes receive a resisting force from the downward projection part 10 so as to be scrubbed and forced into the lower position of drum 6 by the mutual action of the resisting force from projection parts 10 and the force from the rotary motion from movable drum 6. Moreover, clothes are pushed to the center of washing tub 4 by the reaction of projection parts 10.

Figure 3:
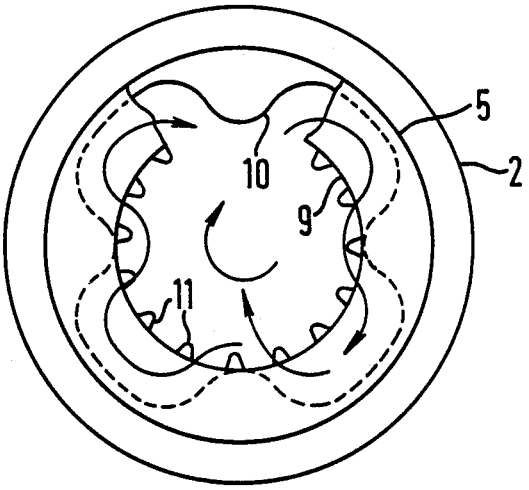
FIG. 3 is a fragmentary top view of a washing tub according to the first embodiment of the invention.
Figure 4:
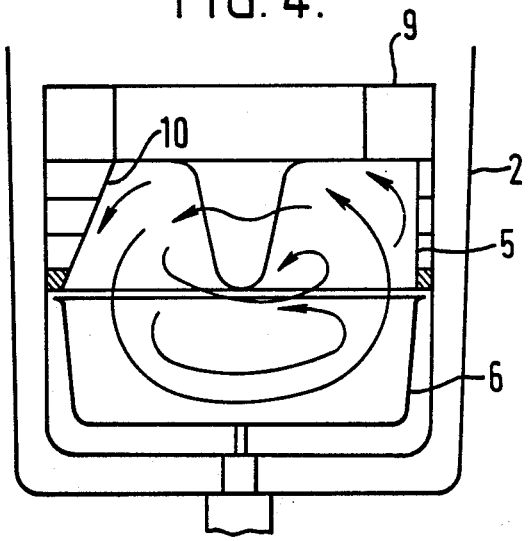
FIG. 4 is a sectional side view showing water flow within the washing tub of the first embodiment of the invention.

Accordingly, clothes are forced to move in a rather convoluted pattern within the washing tub, as shown in FIGS. 3 and 4. The clothers are thus actively moved in all direction, i.e., upwardly, downwardly, inwardly, outwardly, and sideways to be thoroughly washed.

Moreover, clothes are also thoroughly washed in the vicinity of the water-surface in contact with projecting ribs 11.

In the above-described embodiment of the washing machine, as clothes are washed as a result of contact friction between fixed drum 5 and movable drum 6, the frictional force becomes larger as the amount of clothes increases. Therefore, the clothes are thoroughly washed regardless of how much clothes are placed in the machine.

Also, when the amount of clothes is relatively small, the clothes are mainly washed as a result of water flow within movable drum 6, since the clothes do not frequently touch the wall of movable drum 6 so that the contact friction force is very small. Accordingly, since the water flow is not so vigorous as in the conventional agitator type washing machine, the clothes are effectively washed without damage regardless of the amount of clothes being washed.

In the foregoing embodiment, the drying operation is effected by rotating the washing tub 4 in one direction after draining of washing liquid through drain valve 38. At that time, electromagnet means 36 continues to operate so as to force clutch mechanism 19 to wind up clutch spring 31, and brake mechanism 20 does not prevent the movement of fixed drum 5.

Figure 5:
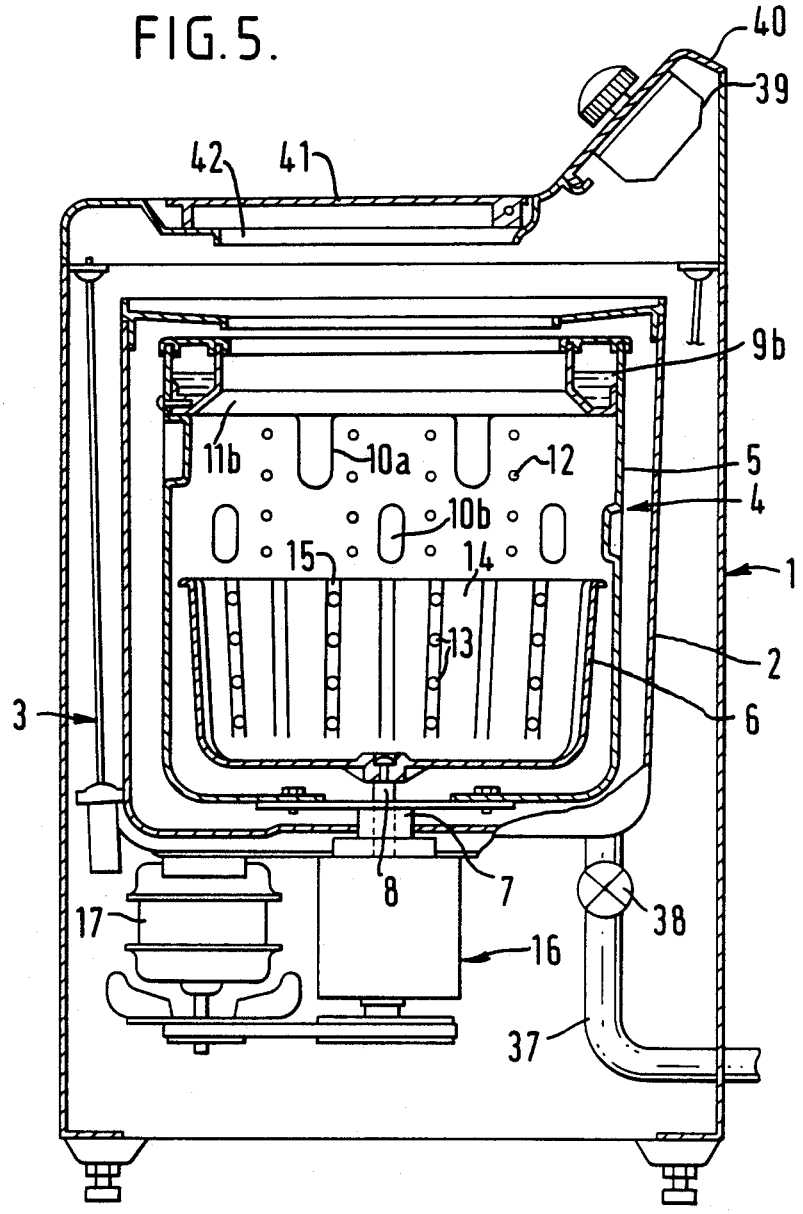
FIG. 5 is a vertical sectional view showing a second embodiment of the invention.
Figure 6:
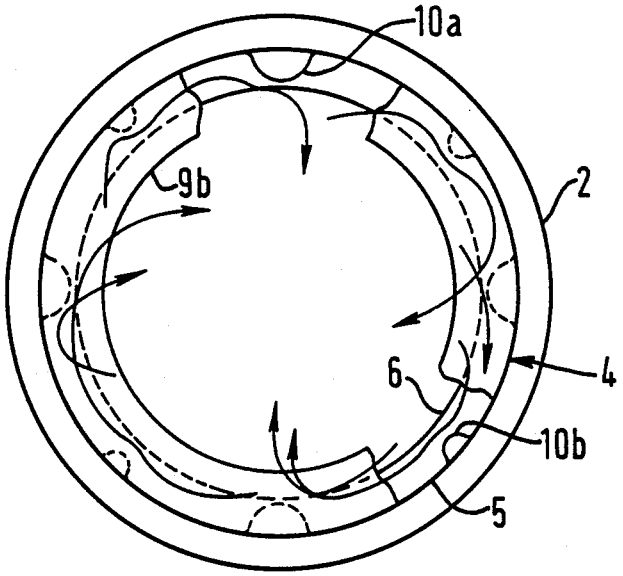
FIG. 6 is a fragmentary top view of the washing tub according to the second embodiment of the invention.
Figure 7:
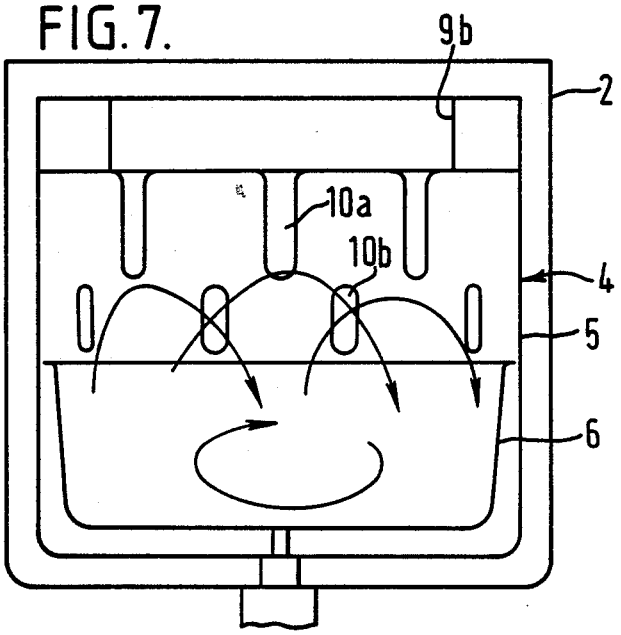
FIG. 7 is a sectional side view showing water flow within the washing tub of the second embodiment of the invention.

A second embodiment of the washing machine is shown in FIGS. 5 through 7, in which a different style of the fixed drum is illustrated. The fixed drum 5 has a pair of projection parts 10*a*, 10*b*, which are alternately formed above and below the inner wall of drum 5. The parts 10*a*, 10*b* are respectively in the shape of a half-circle in cross section, in which the radius of part 10*a* is longer than that of part 10*b*. In this case, balancer 9*b* is formed in the shape shown in FIG. 5, and has an inclined portion 11*b* instead of projecting ribs 11 of FIG. 1.

Thus, clothes receive resisting force from the projection parts 10*a* and 10*b*. The topmost clothes are forced into the lower position of washing tub 4 to be turned from below and above. Since the projection parts 10*a*, 10*b* are alternately formed toward the top and bottom of fixed drum 5, clothes are thoroughly washed since they contact projection parts 10*a*, 10*b* and further receive a downward motion component by means of inclined portion 11*b*, as shown in FIGS. 6, 7. Namely, clothes are forced to move generally vertically by projecting parts 10*a*, 10*b* as well as to move laterally by movable drum 6.

Figure 8:
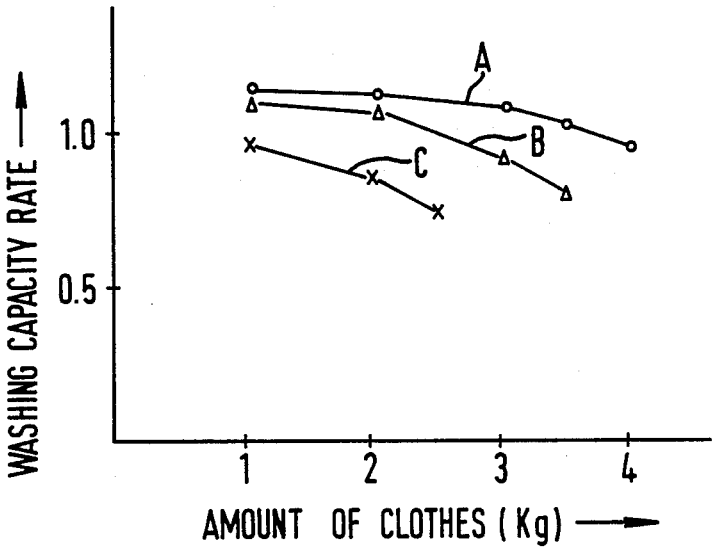
FIG. 8 is a graph showing washing power characteristics using various washing methods.

It is shown in FIG. 8 that the washing power of a washing machine according to the invention is excellent in comparison with conventional washing machines. FIG. 8 is a graph of experimental results showing washing power characteristics according to the amount of clothes in several types of washing machines, namely: a washing machine according to the invention (A); a conventional washing machine of the rotating agitator type (B); and a recent washing machine of the pure rotating washing tub type (C) described in the background section above.

Finally, the washing machine in accordance with the invention has a washing tub including a fixed drum mounted on the upper side thereof, and a movable drum disposed under the fixed drum, so that with a small load of clothes, the clothes are mainly washed by water flow within the movable drum, and, with a large load, the clothes are washed by water flow and as a result of contact friction between the fixed drum and movable drum. Accordingly, clothes are washed thoroughly without damage.

Also, since projection parts are formed on the inner wall of the fixed drum, clothes are thoroughly washed as a result of stirring same up and down during rotatory motion thereof.

While the invention has been described in reference to preferred embodiments, it will be understood by those skilled in the art that various modifications may be made without departing from the spirit and scope of the invention as set forth in the appended claim.

What is claimed is:

1. A washing machine comprising:

a housing;

a washing tub, installed on said housing;

a fixed drum, mounted on the upper side of said washing tub, for contacting clothes during washing cycles, said fixed drum having a plurality of agitating projection parts over the inner wall thereof for providing clothes with a contact friction force during the washing cycles, each of said projecting parts being in the shape of an upside-down triangle which decreases in thickness from an upper surface thereof to a lower surface thereof; and a movable drum receiving said clothes and a washing liquid and disposed under said fixed drum so as to rotate horizontally in alternating directions of rotation within said washing tub; said movable drum having no upside-down triangular shaped agitating projecting parts thereof.

2. A washing machine according to claim 1, wherein the height of said movable drum is about half that of said washing tub.

3. A washing machine according to claim 1, wherein said movable drum is rotated in forward and reverse directions by a driving motor through a transmission.

4. A washing machine according to claim 3, wherein said driving motor and transmission rotate said movable drum at speeds of about 120–180 revolutions per minute and wherein the direction of rotation is alternated every two to three revolutions.

5. A washing machine according to claim 4, wherein said washing tub has a balancer member at the top thereof for balancing rotation of said movable drum, said balancer member including projecting ribs for forcing clothes to move downwardly.

6. A washing machine according to claim 4, wherein said washing tub has a balancer member at the top thereof for balancing rotational motion of said movable drum.

7. A washing machine according to claim 4, wherein said balancing member has an inclined smooth inner surface.

8. A washing machine according to claim 1, wherein said washing tub has a balancer member at the top thereof for balancing rotation of said movable drum, said balancer member including projecting ribs for forcing clothes to move downwardly.

9. A washing machine according to claim 1, wherein said washing tub has a balancer member at the top thereof for balancing rotational motion of said movable drum.

10. A washing machine according to claim 9, wherein said balancer member has an inclined smooth inner surface.

11. A washing machine according to claim 1 further comprising means for rotating said movable drum at speeds of about 120–180 revolutions per minute and for changing the direction of rotation about every two to three revolutions.

12. A washing machine comprising:

a housing;

a washing tub, installed on said housing;

a fixed drum, mounted on the upper side of said washing tub, for contacting clothes during washing cycles, said fixed drum having a plurality of agitating projection parts over the inner wall thereof for providing clothes with a contact friction force during the washing cycles wherein said projecting parts are alternately formed on an upper and lower portion of said fixed drum and wherein each of said projecting parts has a cross-sectional shape in the form of a half-circle wherein the radii of the projecting parts formed on the upper portion are longer than the radii of the projecting parts formed on the lower portion; and a movable drum receiving said clothes and a washing liquid and disposed under said fixed drum so as to rotate horizontally in alternating directions of rotation within said washing tub; said movable drum having no alternately formed projecting parts thereof.

13. A washing machine according to claim 12 further comprising means for rotating said moveable drum at speeds of about 120–180 revolutions per minute and for changing the direction of rotation about every 2 to 3 revolutions.

* * * * *